US005207590A

United States Patent [19]

Benda

[11] Patent Number: 5,207,590

[45] Date of Patent: May 4, 1993

[54] FUSE LOCK OUT

[76] Inventor: Steven J. Benda, Box 782, Cokato, Minn. 55321

[21] Appl. No.: 801,030

[22] Filed: Dec. 2, 1991

[51] Int. Cl.[5] ..... H01R 13/44

[52] U.S. Cl. ..... 439/148; 439/621; 337/210

[58] Field of Search ..... 439/133, 148, 621, 622; 337/208-212, 186, 226

[56] References Cited

U.S. PATENT DOCUMENTS 4,669,794 6/1987 Benda ..... 439/148
5,079,390 1/1992 Costanzo et al. ..... 200/50 AA

*Primary Examiner*—Gary F. Paumen

[57] ABSTRACT

A blocking member and a clamp as separate members, each a single, one-piece article. The blocking member has a canister form blocking element positionable in the clip which normally holds the fuse, and an arm extending therefrom. The blocking member also has fingers extending longitudinally of the canister to engage with the fuse clip, thus preventing vertical movement of the blocking member out of the fuse clip. The clamp is slidably fitted on the arm and moved to a locking position in which it prevents horizontal movement of the blocking element from the fuse clip. The arm and the clamp have holes that are aligned when the clamp is in locking position, for receiving an external locking means.

10 Claims, 2 Drawing Sheets

FUSE LOCK OUT

BRIEF SUMMARY OF THE INVENTION

The invention resides in the field of electrical maintenance. Maintenance men in the field must often de-energize certain electrical circuits, and this is often done by blocking out fuses.

Reference is made to my prior U.S. Pat. No. 4,669,794 dated Jun. 2, 1987 which covers an invention in this field, electrical maintenance, and is directed specifically to a fuse block out, for de-energizing a corresponding electrical circuit. The present invention is directed to that kind of fuse block out with means for locking it in place, thereby locking the corresponding circuit in the de-energized condition.

A broad object of the invention is to provide, in connection with a fuse block out, a lock out mechanism for locking the block out member in the blocked position.

Another object is to provide such a lock out means, made up of two parts, and only two parts, that are of extremely simple design and construction, easily handled and put in place, and inexpensive to manufacture.

A further object is to provide a lock out mechanism of the foregoing character, which enables detail steps, for putting it in locking condition, to be performed in an area remote from energized components, and then easily and simply put in place, and locked, in association with those components, in de-energized condition of the latter.

A more specific object is to provide a mechanism of the character just referred to, adapted to the use of a simple tie wrap for effecting the locking condition.

Still another object is to provide a device of the foregoing character, in which each of the two parts is a one-piece, integral molded article.

DETAILED DESCRIPTION

Figure 1:
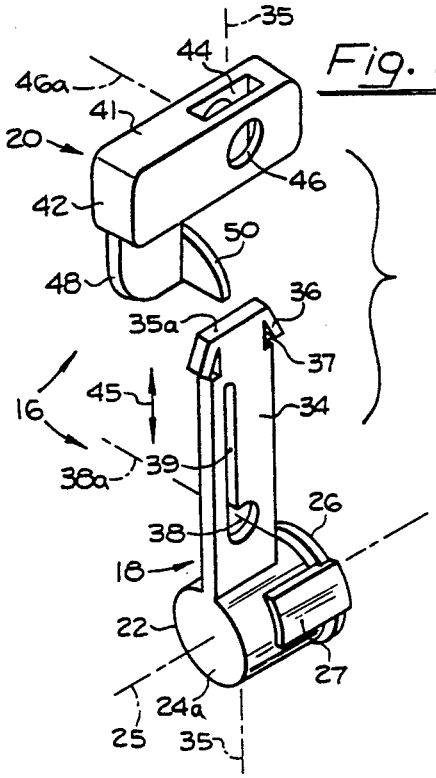
FIG. 1 is a perspective view of the lock out device of the invention.

Referring in detail to the drawings, the fuse lock out device of the invention is shown in its entirety at 16 in FIG. 1, and is made up of entirely of two parts, namely a blocking member 18 and a slide, or clamp 20. Each of these two parts is a single, one piece, integral member; and they are fitted or snapped together as described below. The parts are preferably of molded plastic, and of course of high dielectric characteristics, and preferably of bright red color in accordance with usual danger signaling. They are rigid, of great strength, and non-yielding except in a certain instance referred to below.

For convenience, the device is described or oriented as in FIG. 1, but it may, and often does, assume other orientations, and the description is to be interpreted accordingly.

Figure 9:
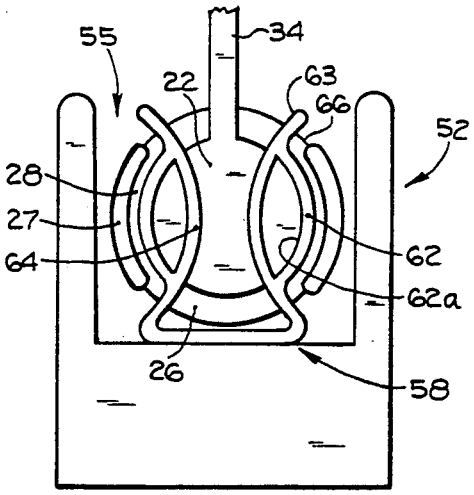
FIG. 9 is an end view taken at line 9—9 of FIG. 8.

The blocking member 18 includes a blocking element 22 of canister type, which includes a cylindrical main part or blocking element 24 having a front end **24*a* and having a longitudinal central axis 25 so referred to for convenience. The blocking element 24 includes an enlarged disc or flange 26 at a rear end coaxial with the element 24 forming a stop element, and locking fingers 27 at the sides secured to the radial outer surface of the stop element 26 and extending in a forward direction a distance less than the length of the element 24. The locking fingers are therefore spaced radially from the element 24, leaving spaces 28 therebetween. (FIG. 9**)

Figure 12:
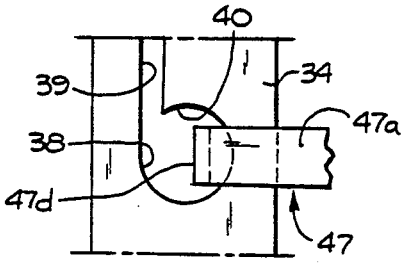
FIG. 12 is a view oriented according to FIG. 10 but at a position lower than FIG. 10.

The blocking member 18 includes a thin plate-like arm 34 extending radially upwardly from the element 24, having a longitudinal axis 35. At its outer end **35*a*, the arm has stop fingers 36 at its side edges extending generally downwardly, and normally outwardly at a small angle. These fingers constitute a lock head, or slide stop, and because of their small dimension they can be flexed inwardly into notches 37, as referred to again hereinbelow. The arm has a transverse hole 38 therethrough, adjacent its inner end, the axis of the hole being shown at 38*a*. Leading upwardly from the hole, is a slot 39, tangent to the hole, a solid segment 40 (FIG. 12) of the margin of the hole, being positioned for engagement by a tie wrap and preventing movement of the tie wrap in direction toward the outer end of the arm, as referred to again hereinbelow. The hole 38** need not be round, but is wider than the slot.

The slide or clamp 20 includes a body portion 41 with a hook-like element 42 at one end. The body portion 41, considered as oriented in FIG. 1, or horizontal, has a vertical slot 44 therethrough, and a transverse hole 46, this hole extending through the slot, the axis of the hole being shown at **46*a***. The slot and hole will be referred to again hereinbelow.

The hook-like element 42 extends downwardly from the body portion and has a reversely extending portion 48 terminating in a horizontal stop element 50. The interrelation between the parts 18 and 20, will be described hereinbelow.

Figure 2:
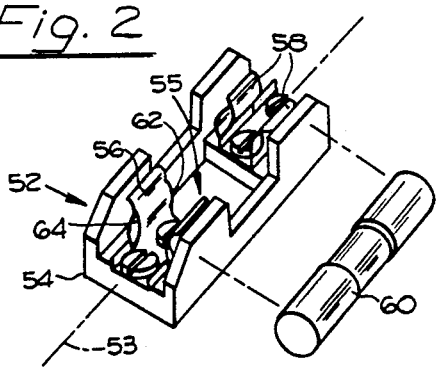
FIG. 2 is a perspective view of a fuse block, showing a fuse associated therewith but in the detached position.

A fuse block, with which the device of the invention is to be used, is shown at 52 in FIG. 2. This fuse block is of known construction, having a central longitudinal axis 53, and includes a base 54 of box-like shape with a space 55 opening upwardly, and including fuse clips 56 at its ends for holding the fuse. Each clip includes a pair of fingers 58 on opposite sides of the axis 53, spring biased toward each other for releasably retaining the fuse therein. The fuse is shown at 60 removed from the fuse block. The fingers of each clip have concave elements 62, for receiving and directly engaging the fuse, and for receiving the element 24 of the present block out when the latter is in place. The concave elements define a cylindrical space **62*a* FIG. 9). The fingers also have outwardly turned upper tips 63, and elements 64 extending into the projection of the cylindrical space defined by the elements 62, and serve as end stop means for holding the fuse. They are also utilized in the present case in locking of the blocking member 18** horizontally in place.

Figure 3:
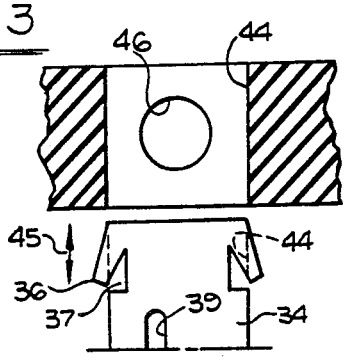
FIG. 3 is a fragmentary side view, partly in section of the upper portion of the elements of FIG. 1, but with the parts more closely positioned.

In the use of the lock out device, the two parts 18 and 20, although made of separate, integral pieces, are fitted together, and when so fitted together, they normally are not separable. In so fitting them together, the slide or clamp 20 is fitted on the arm 34, by inserting the outer end 35*a* of the arm through the slot 44 in the slide, as indicated by the double headed arrow 45 in FIG. 1. In this step, the end edges of the slot 44 engage the stop fingers 36 (FIG. 3) and flex them into the notches 37, and the slide rides over them. After the slide thus passes the fingers, the fingers spring back to their outer position (FIG. 4), and normally prevent the slide from being drawn off the arm.

When the slide 20 is thus on the arm 34, beyond the stop fingers 36, the hole 46 is in register with the slot 39 (FIG. 4), enabling a tie wrap 47 to be inserted through the hole and slot for locking the assembled parts in the fuse block, as referred to below.

Figure 10:
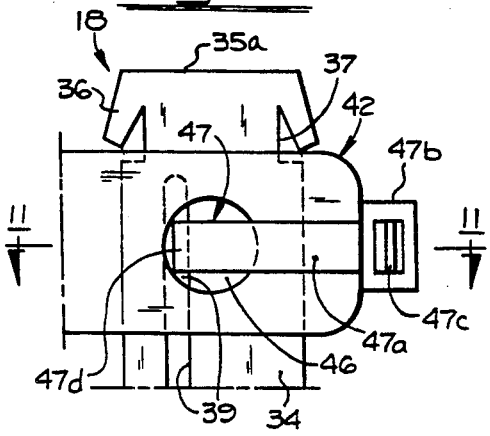
FIG. 10 is a large scale view, partly in section of the upper portion of FIG. 4.
Figure 11:
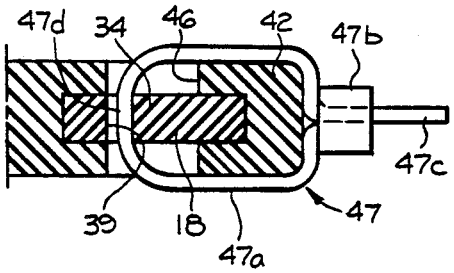
FIG. 11 is a sectional view taken at line 11—11 of FIG. 10.

The tie wrap 47 may be of known type, consisting of a long flexible strip 47*a* and a locking loop 47*b* at one end. It is normally used by wrapping the strip around an article and inserting the free end 47*c* (FIGS. 10 and 11) through the loop, which is then locked therein in a ratchet effect.

Figure 4:
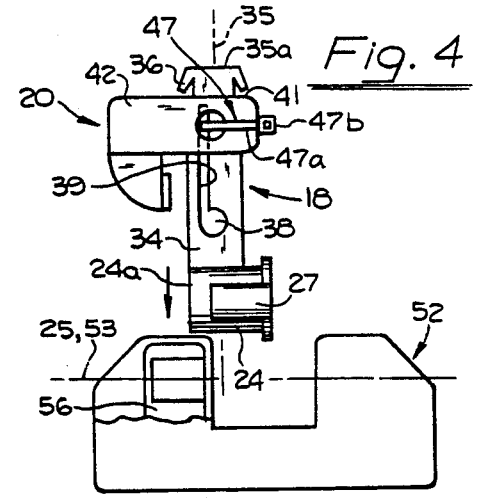
FIG. 4 is a side view of the lock out device in a first step in inserting it in the fuse block.
Figure 5:
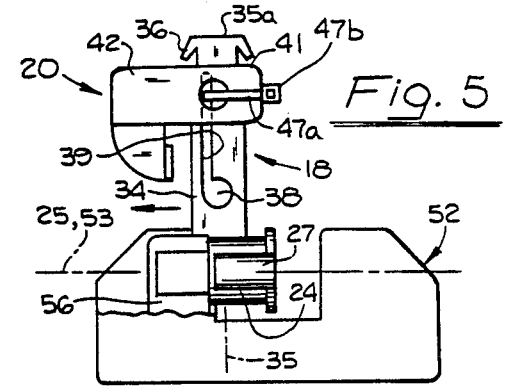
FIG. 5 is view oriented according to FIG. 4 and showing a second step relative to FIG. 4.

In the preferred use of the device, after the slide 20 is applied to the arm, and in the position thereof shown in FIG. 4, the tie wrap 47 is applied, i.e., the free end of the strip is inserted through the hole 46, and the slot 39, and looped around and inserted through the loop 47*b*, and drawn up taut, in a locking effect.

The steps of putting the device in place are represented in FIGS. 4–7, a portion of the fuse block being broken away in these figures. The device is first positioned as shown in FIG. 4 above the fuse block 52, and with the front end 24*a* of the canister above the clip fingers. The canister element is of greater diameter than the space 62*a* between the fingers, and is forced downwardly into the clip to the position shown in FIG. 5, springing the fingers apart in being so moved. The locking fingers 27 in this step are of course free of the clip fingers 58, and are positioned longitudinally between the two clips, in the space 55.

Figure 6:
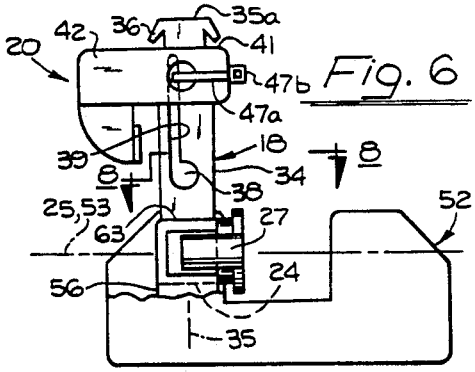
FIG. 6 is a view similar to FIGS. 4 and 5 showing a third step.

As a next step, the device is moved, to the left, to the position of FIG. 6, to move the canister element into the space between the clip fingers, with the stop element 26 engaging those fingers. In this step, the locking fingers 27 ride outside the clip fingers, the latter being received in the spaces 28 (FIG. 9). When the canister element is in the clip, the front end 24*a* thereof may engage the elements 64 of the clip fingers, but not necessarily so.

In this position of the device 16 (FIG. 9), i.e., in the fuse block, the arm 34 with the slide 20 thereon, extends upwardly.

Figure 7:
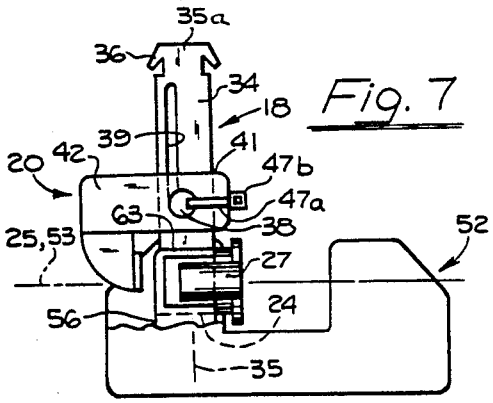
FIG. 7 shows a fourth, and final step.
Figure 8:
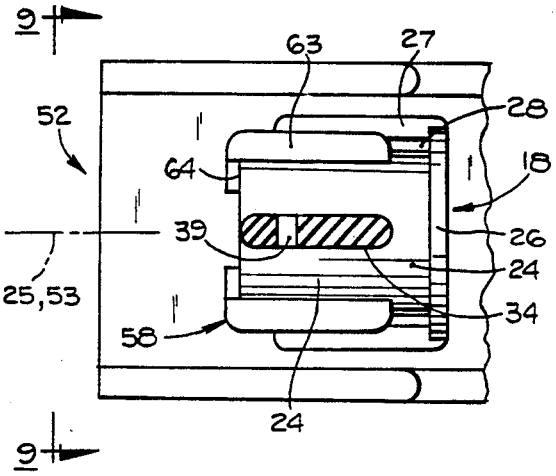
FIG. 8 is a view taken at line 8—8 of FIG. 6.

In the final step, as represented in FIG. 7, the slide 20 is moved downwardly, or slid down on the arm, to the lower, locking position, in which the stop 50 is longitudinally axially in line with the canister element 24. In this position, the stop 50 may engage the clip, acting through the elements 64 of the latter, locking the canister element against withdrawal from the clip in longitudinal or horizontal direction, or to the right in FIG. 7. The device is also locked against withdrawal upwardly, since the clip fingers would have to be spread to release the canister element, and they cannot be spread because they are held against that movement by the locking fingers 27. Additionally, the locking fingers 27 are held against upward movement by the finger tips 63 (FIG. 8) as indicated at 66.

As indicated above, the tie wrap 47, is applied to the device before the device is to be applied to the fuse block. As the slide 20 is slid downwardly to locking position, the tie wrap of course rides with it, the inner looped end 47*d* of the strip 47*a* of the tie wrap riding in the slot 39, and then entering the hole 38 in the lower end of the arm. Since the tie wrap is drawn taut, as noted, the inner looped end falls under the element 40 of the margin of the hole, and would prevent unlocking upward movement of the slide on the arm.

The device when thus in locking position, is locked in all directions against unlocking movement.

A very important safety feature is provided in that the tie wrap can be applied to the device at a position remote from energized components, and so applied by bare hands (unprotected) and thus easily manipulated by two hands. The user may then put on safety gloves, and carry it to the fuse box, and apply it by merely pushing it into the fuse box, and then moving the slide down to locking position. An additional important feature is that no intricate maneuvers are required in actually applying the device to the fuse box.

I claim:

1. A fuse lock out device for use with a fuse block having a space for mounting a fuse therein, and a clip in the space having fingers biased toward each other for yieldably holding the fuse therebetween, comprising, a blocking member having a blocking element and an arm extending from the blocking element, the blocking element being capable of being positioned in said clip and the arm being thereby in a position with the arm extending out of said space, and a slide slideably positionable on said arm to a locking position in which it engages the clip and thereby locks the blocking element in the clip.

2. A device according to claim 1 wherein, in the fuse block, the fingers of the clip are positioned on opposite sides of a central longitudinal axis, and wherein the blocking element is movable into and out of the clip in longitudinal direction along said axis, and wherein the blocking element has a stop element limiting the extent the blocking element can be moved in a first direction into the clip, and the slide, when in said locking position, engages the clip in position preventing movement of the blocking element out of the clip opposite said first direction.

3. A device according to claim 2 wherein, the blocking element has a front end that leads into the clip in moving the blocking element into the clip, and the blocking member has blocking fingers leading forwardly from a rear end of the blocking element and spaced transversely outwardly from the blocking element, and being positioned outwardly of the clip fingers when the blocking element is in the clip.

4. A device according to claim 3 wherein, the clip fingers have free ends between which a fuse is normally moved into the clip, and have inner main portions having interfacing concave surfaces for engaging and holding the fuse, and outer tips inclined away from each other, wherein, when the blocking element is in the clip, the locking fingers engage the outer surfaces of said main portions of the clip fingers, and the locking fingers are in register with the finger tips, relative to direction of said normal movement of the fuse, whereby to prevent movement of the blocking element out of the clip in direction opposite said normal movement.

5. A device according to claim 2 wherein, the slide, when in said locking position, engages said stop element and thereby engages the clip.

6. A device according to claim 1 wherein, the slide is movable on the arm in direction longitudinally of the arm, and said arm and the slide each have a hole therethrough, and the holes are so positioned that when the slide is in locking position, they are aligned on a common axis perpendicular to the longitudinal direction of the arm.

7. A device according to claim 1 wherein, the blocking member and the slide are separate articles, and each is a single, one-piece molded article.

8. A device according to claim 7 wherein, the arm includes, at its outer end, stop fingers extending generally outwardly, yieldable inwardly to enable the slide to pass thereover, and normally occupying laterally extended positions preventing the slide from being withdrawn from the arm.

9. A device according to claim 6 wherein, the arm has a slot therethrough leading from the hole in the arm to a position adjacent its outer end, enabling a tie to be inserted through the hole in the slide and the slot, when the slide is adjacent said outer end, for tying the slide to the blocking member, and enabling the tie to ride inwardly along the slot into the hole in the arm, in response to moving the slide inwardly along the arm.

10. A device according to claim 9, wherein, the slot is positioned at one side of the hole in the arm, and the margin of the hole has a portion extending transversely of the slot forming a stop element.

whereby, the tie, when in the hole in the arm, and in response to its being drawn taut, engages said stop element, and prevents movement of the slide outwardly of the arm.

* * * * *